US010502485B2

(12) United States Patent
Adams et al.

(10) Patent No.: US 10,502,485 B2
(45) **Date of Patent: *Dec. 10, 2019**

(54) FOAM DRYING APPARATUS

(71) Applicant: Worthen Industries, Nashua, NH (US)

(72) Inventors: Steven E. Adams, Richmond, VA (US); Andrew T. Sinclair, Richmond, VA (US); Robert J. Rose, Richmond, VA (US); Ian L. Churcher, Richmond, VA (US)

(73) Assignee: Worthen Industries, Nashua, NH (US)

( * ) Notice: Subject to any disclaimer, the term of this patent is extended or adjusted under 35 U.S.C. 154(b) by 55 days.

This patent is subject to a terminal disclaimer.

(21) Appl. No.: 15/958,664

(22) Filed: Apr. 20, 2018

(65) Prior Publication Data

US 2018/0252470 A1 Sep. 6, 2018

Related U.S. Application Data

(63) Continuation of application No. 15/435,347, filed on Feb. 17, 2017, now Pat. No. 10,012,440.

(Continued)

(51) Int. Cl.
*F26B 3/06* (2006.01)
*F26B 5/12* (2006.01)

(Continued)

(52) U.S. Cl.
CPC ..... *F26B 3/06* (2013.01); *F26B 5/12* (2013.01); *F26B 9/066* (2013.01); *F26B 21/004* (2013.01);

(Continued)

(58) Field of Classification Search
CPC .... F26B 3/06; F26B 5/12; F26B 9/066; F26B 21/004; F26B 25/003; F26B 25/066; F26B 2015/003; F26B 9/06

(Continued)

(56) References Cited

U.S. PATENT DOCUMENTS 3,007,256 A 11/1961 Rouy
3,487,557 A * 1/1970 Linstead ..... D06F 58/10 34/619

(Continued)

FOREIGN PATENT DOCUMENTS

CA 2878727 A1 * 1/2013 ..... B01D 21/2405

OTHER PUBLICATIONS

Non Final Office Action U.S. Appl. No. 15/871,380 dated Jun. 28, 2019.

*Primary Examiner* — Stephen M. Gravini
(74) *Attorney, Agent, or Firm* — Lambert Shortell & Connaughton; Gary E. Lambert; David J. Connaughton, Jr.

(57) ABSTRACT

A foam drying apparatus is provided. The apparatus is configured to pass air, and in some cases heated and/or dried air, through a quantity of foam. This air passing through the foam absorbs or otherwise carries moisture out of the foam, drying it. The apparatus may utilize a pressure differential on opposite sides of the foam, causing air on the higher pressure side to pass through the foam. Typical applications may include the drying of foam assemblies which use water based adhesives to accelerate drying of the adhesive and/or removal of water from the foam assembly, and packaging of the foam assembly.

20 Claims, 5 Drawing Sheets

Related U.S. Application Data

(60) Provisional application No. 62/350,908, filed on Jun. 16, 2016, provisional application No. 62/396,862, filed on Sep. 20, 2016.

(51) Int. Cl.
*F26B 9/06* (2006.01)
*F26B 25/00* (2006.01)
*F26B 21/00* (2006.01)
*F26B 15/00* (2006.01)

(52) U.S. Cl.
CPC ..... *F26B 25/003* (2013.01); *F26B 2015/003* (2013.01)

(58) Field of Classification Search
USPC ..... 34/73
See application file for complete search history.

(56) References Cited

U.S. PATENT DOCUMENTS 3,750,305 A * 8/1973 Loser ..... F26B 13/006 34/573
4,358,899 A 11/1982 Murch
4,480,990 A 11/1984 Beam
4,906,265 A * 3/1990 Berfield ..... A47L 7/0028 493/186
5,025,572 A * 6/1991 Cordier ..... A01K 13/001 34/201
5,338,189 A 8/1994 Hata
5,378,144 A 1/1995 Cress
5,827,385 A * 10/1998 Meyer ..... B29C 44/56 156/87
5,931,991 A * 8/1999 Leon ..... A47L 7/0028 15/347
6,161,304 A 12/2000 Iaccino
6,223,449 B1 * 5/2001 Johnson ..... F26B 21/086 34/618
9,677,811 B2 * 6/2017 Ishibashi ..... F26B 5/08
9,739,531 B2 8/2017 Goulet
10,012,440 B2 * 7/2018 Adams ..... F26B 3/06
2008/0256826 A1 10/2008 Zarembinski
2009/0293302 A1 12/2009 Jonaitis
2013/0333238 A1 * 12/2013 Thiyagarajan ..... A47L 15/48 34/476
2017/0363352 A1 * 12/2017 Adams ..... F26B 3/06
2018/0252470 A1 * 9/2018 Adams ..... F26B 3/06

* cited by examiner

FOAM DRYING APPARATUS

BACKGROUND

In foam assembly processes, such as foam mattress assembly, water based adhesives provide a safe, effective, and non-hazardous solution for bonding foam pieces together. However, the adhesive contains a large percentage of water. Therefore if a foam assembly bonded with water-based adhesives is packaged before fully dried, mold, unpleasant odors, substrate material breakdown, and the like may develop.

Further, even aside from the water of the water-based adhesives, foam can contain appreciable amounts of water, such as 1% to 2% water by weight, based solely on how it is stored. If stored in humid environments, the foam will retain a higher percentage of water weight compared to being stored in low humidity conditions. This water can also be a problem for mold and mildew growth when the mattress is packaged. This water, even on its own, can cause issues, and these issues may be compounded when water-based adhesives are present.

In particular, in foam mattress assembly and other assembled foam products, a fast growing trend in industry is to compress said assemblies into a box that may be shipped directly to customers. The boxes are sized such that traditional package shipping companies can handle them. These foam mattresses are laminated, and then enclosed in an impermeable plastic bag which is vacuumed and compressed so that it fits into the mattress boxes. Vacuuming alone to compress the package does not adequately extract water from the package, so trapped moisture is a common occurrence. Currently, the primary solution for this problem is to simply let the foam assemblies rest for a certain time period. However, this slows down the manufacturing and shipping process, and requires extra storage space at the manufacturing site.

Therefore, what is needed is a system that may allow for rapid drying of the assembled adhered foam elements to allow for a shorter processing time between assembly and packaging.

SUMMARY

The subject matter of this application may involve, in some cases, interrelated products, alternative solutions to a particular problem, and/or a plurality of different uses of a single system or article.

In one aspect, the present invention involves an apparatus configured to remove moisture from laminated foam assemblies. The present invention operates generally by drawing air through a foam product. In a particular aspect, a vacuum box is provided that provides walls and a base to support a foam assembly that can be quickly and easily moved into and out of the box for drying of the adhesive by drawing air through the foam assembly. As this air passes through the foam assembly, moisture within the foam, either from the atmosphere and/or water based adhesive is evaporated, allowing for more effective, safe, and sanitary long term packaging.

DETAILED DESCRIPTION

Figure 1:
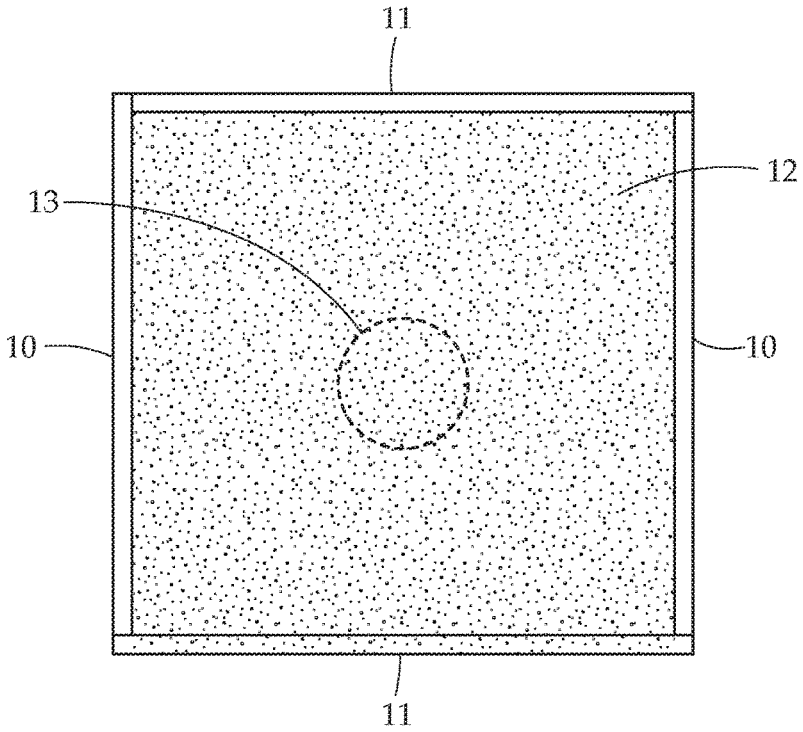
FIG. 1 provides an elevation view of one embodiment of the foam drying apparatus of the present invention.

The present invention concerns an apparatus to reduce or eliminate water from a foam assembly. The present invention involves an apparatus that is configured to draw air through laminated foam assemblies such as foam mattresses and the like. Generally, the apparatus provides a base area and sidewalls on which the foam assembly may be placed and supported. For example, the foam assembly may be placed on a rack, rollers, and the like. Below, or otherwise adjacent to the base, a vacuum attachment allows a vacuum to be drawn on, and applied to, all or nearly all of a surface area of one face of the foam assembly. The vacuum attachment applies the reduced pressure to the surface area of the foam assembly. The apparatus is configured to be operated for a period of time on a foam assembly sufficient to adequately dry the foam assembly. This time frame may vary depending on the variables particular foam assembly such as its size and the amount of adhesive used. Air on the opposite side of the foam assembly is drawn through it towards the vacuum attachment. As the air passes through the foam assembly, moisture is evaporated and carried out of the foam.

As used herein, a foam assembly may be any assembly that comprises two or more foam pieces laminated together using an adhesive. It is even possible that a foam assembly may be a single foam element. Foam assemblies may be any size, shape, foam type(s), and configuration, without straying from the scope of the present invention.

In one embodiment, the present invention provides a vacuum box for drying rectangular foam assemblies, for example mattresses. The box is formed of an air permeable base on which a foam assembly may rest, as well as side walls to cover the sides or part of the sides of the foam assembly held therein. A vacuum attachment, such as a pipe and a spacing underneath the base allows a low pressure zone to be applied to a foam assembly resting on the base. In some embodiments, the base may have a plurality of rollers so as to allow the foam assembly to be rolled into position for drying.

In a particular embodiment, around a perimeter of the vacuum box are four side walls configured to abut the sides of the foam assembly. In some embodiments, one or more walls may have vents allowing air to pass through. For example, these vents may be located at typical core heights where two foam layers are adhered together. In one embodiment shown, vents are positioned at 4, 5, 6, 7, 8, and 9 inches from a base of the foam assembly. By allowing air flow over the sides of the foam assembly, particularly at adhesion points, the adhesive may be dried more quickly particularly at the seams.

Some embodiments of the drying system may be particularly configured and sized for mattress drying (though it may be used for the drying of any foam assembly). As such, one of the side walls may be adjustable to adapt to varying widths of mattresses as shown in the various broken vertical lines of FIG. 4 (discussed in detail below). Further, an end wall may be adjustable to adapt to varying lengths of mattresses as shown by the various broken horizontal lines of FIG. 4. Once the box is sized, the foam assembly may be moved or slid into position, vacuum drawn, and then moved or rolled out of the box. Sizing of the vacuum area may vary greatly and is not a limiting aspect of the present invention.

A stationary side or end wall may be equipped with inflatable bag portions along all or part of the side wall. These inflatable bag portions allow a seal to be formed against both side walls by urging against the foam assembly once inflated, and in turn pushing it against the opposing side wall. By forming this seal, air is more directly forced through the foam assembly, increasing air flow through the assembly which in turn increases drying rate of the adhesive. A similar inflatable bag structure may be applied to at least one end wall as well. The bags may then either be deflated to release the foam assembly, or may remain inflated until a differently sized foam assembly is to be dried in the vacuum drying assembly.

Common mattress sizes include:

Twin: 38"×74.5"
Twin XL: 38"×79.5"
Full: 53"×74.5"
Full XL: 53"×79.5"
Queen: 60"×79.5"
King: 76"×79.5"
California King: 71"×83.5"

Accordingly, the adjustable side and end walls of the vacuum box may be adjustable to these sizes to be used for all common mattress sizes. In one embodiment, the adjustable walls may be adjusted to fit within close tolerances (+/− one inch) to these sizes. In another embodiment, the adjustable walls may be configurable to leave a minor spacing between the expected size and the walls, and then the inflatable bags, pads, or the like, may be used to ensure proper sizing. This embodiment may allow for movement into and out of the vacuum box without wall interference or friction. In one non-limiting example, the adjustable walls may be configured to be spaced as follows for the different mattress size operation:

Twin: 39"×75"
Twin XL: 39"×81"
Full: 54"×75"
Full XL: 54"×81"
Queen: 61"×81"
King: 77"×81"
California King: 72"×85"

In some embodiments, a heat source may be present on an opposite side of the foam from the vacuum draw side. The heat source serves to heat air that is drawn towards and through the foam assembly. The heat source may be any structure capable of increasing the temperature of ambient air. For example, a convection heat source, infra-red heat source, and the like. In a particular further embodiment, a fan or other air moving structure may force air, such as heated air, towards the foam assembly to further enhance the transport of the air through the foam assembly. Heated air has a greater moisture transport capacity compared to ambient temperature air. Therefore, as heated air is urged through the foam assembly, it picks up more moisture from the foam, allowing the foam to dry faster. In varying embodiments, heated air may range from 80-275 degrees Fahrenheit, but lower and higher temperatures may also be used without straying from the scope of this invention. Typically, embodiments of foam being dried may be able to handle temperatures of up to 250 to 275 F for short periods of time without damage.

In another embodiment, desiccated, dehumidified, or otherwise dry air may be used for passage through the foam. By passing dry air, as opposed to moist ambient air, through the foam assembly, moisture absorption may be more rapid and efficient. The term "dry air" is used herein to refer not only to fully dry air, but also air that has a lower moisture content than surrounding ambient air. The dry air may be used in addition to the heat source (providing hot, dry air), or as an alternative to it. This dry air embodiment may be particularly useful in non-air conditioned assembly facilities that may have higher than normal humidity levels.

The present invention has, in initial tests, provided drastically enhanced performance compared to the prior art method of simply letting the foam assemblies rest at ambient conditions. For example, substantial and sufficient drying and adhesion (foam tear) has been achieved in only five minutes of drying using this drying apparatus. Equivalent drying and adhesion of the foam assembly at ambient conditions may take up to six hours or more. Depending on permeability and moisture content of the foam assembly, more or less time on the drying apparatus may be required, however this applies even more so when drying at ambient temperatures. For example, if ten to fifteen minutes on the drying apparatus of the present invention is required, the drying time at ambient temperature may be ten to twelve hours. As such, even if additional time is required on the drying machine, it is on the order of minutes, as opposed to hours using prior art techniques.

In one embodiment of drying a foam mattress, a top foam layer may be coated with adhesive, and then placed on a core foam layer. In such an embodiment, either the top layer or core may be closest to the vacuum source that draws the vacuum, however typically the core layer will be facing the vacuum attachment. Further, by drawing air through the foam, there is a compression of the layers together, which may aid in final adhesion.

Any type of foam assembly may be dried using the present invention. As such, the apparatus, rack, funnel, body providing structure for the apparatus, and the like may be any shape and size to receive a particularly sized foam assembly for drying. Further, in some embodiments, an adapter may be installable to allow for varied sizing, while maintaining a snug fitting around the foam assembly so that air does not simply go around the foam assembly instead of through it. Similarly, the present invention may be operated in any orientation, whether that be drawing air downward, to a side, or upwards, without straying from the scope of the present invention.

In one exemplary embodiment of operation, a laminated foam assembly product may be either transferred from its assembly position onto a support rack of the drying assembly, or may be assembled in place on the drying assembly. Once the foam elements are assembled and laminated together by water-based adhesive, the system may be activated. Activation involves drawing a low pressure area so that the foam assembly is between the low pressure area and the atmosphere, which in turn draws air through the foam assembly. In some embodiments, as noted, this air may be heated by a heating device adjacent to the foam assembly on the opposite side of the assembled foam from the vacuum attachment. In a particular embodiment, air being drawn through the foam assembly by the drying apparatus may be initially heated for part of processing time, and then may be ambient temperature or otherwise cooler than the heated air for part of the processing time. In this embodiment, the foam assembly may be cooled so as not to be excessively hot during packaging. For example, in a five minute drying process, an initial three minutes may be using heated air, while a last two minutes may be using cooler air than the heated air.

Figure 2:
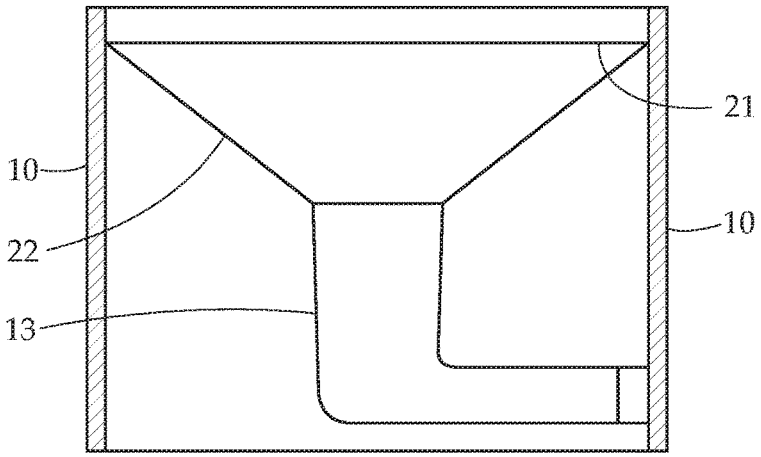
FIG. 2 provides a side view of an embodiment of the present invention.

Turning specifically to the figures, multiple embodiments of the present invention are provided. A simple embodiment of the drying system of the present invention is shown in FIGS. 1 and 2. In these figures, the invention is formed as a body having side walls 10 and end walls 11. A rack 21 serves as an air permeable base on which a foam assembly may rest. An air outlet 13 below the rack 21 is configured to have a vacuum pump (not shown) attached thereto in order to draw a low pressure below the rack 21, causing exterior air to pass through the rack 21 (and any foam assembly thereon). A funnel 22 may provide an effective structure of the vacuum attachment to draw the low pressure zone over an entire area of the rack 21, though it should be understood that any structure may be used.

Figure 3:
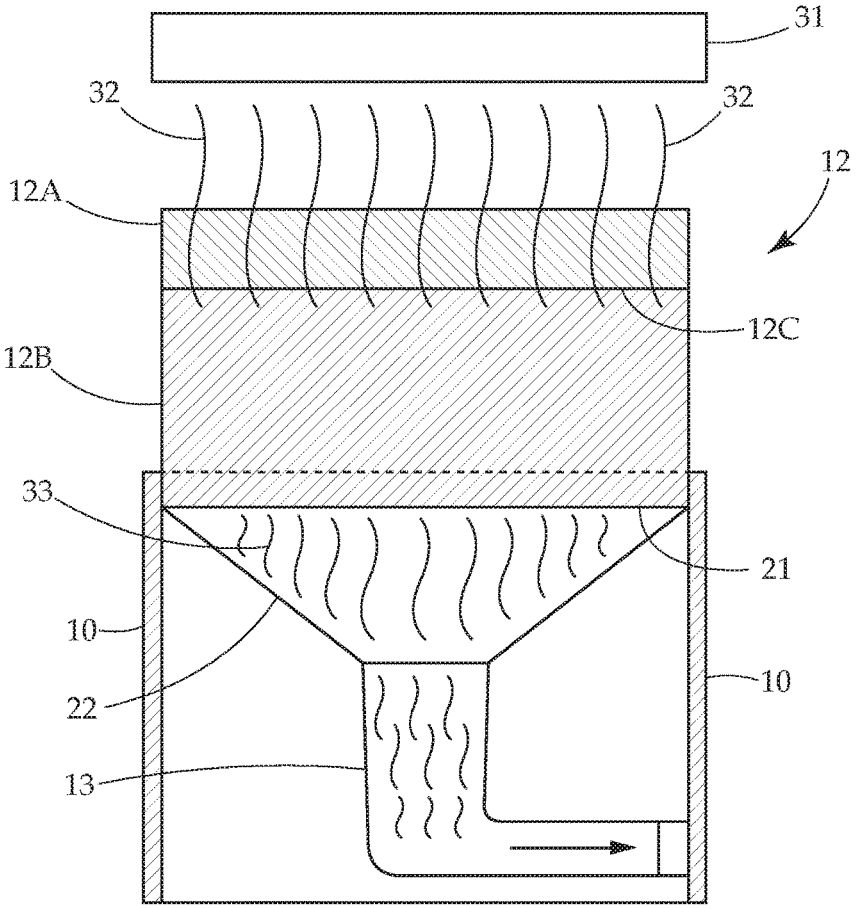
FIG. 3 provides a side view of another embodiment of the present invention.

FIG. 3 provides a side view of an embodiment of the drying system having a foam assembly 12 resting on rack 21. The foam assembly 12, in this embodiment, is formed of a top foam layer 12A, and a bottom foam layer 12B, bonded together by an adhesive 12C. A heat source 31 heats air 32 as it passes towards the foam assembly 12 because of the low pressure zone applied by the vacuum source (not shown) through the air outlet 13 and funnel 22. Such an embodiment utilizes the ability of heated air to carry more moisture than cool air, which allows more effective removal of water from the foam assembly by the heated air 32 passing through. This air collects moisture and becomes moist air 33 after passing through foam assembly 12. Moist air 33 moves through the funnel 22 and outlet 13 in direction A as directed by the outlet 13.

Figure 4:
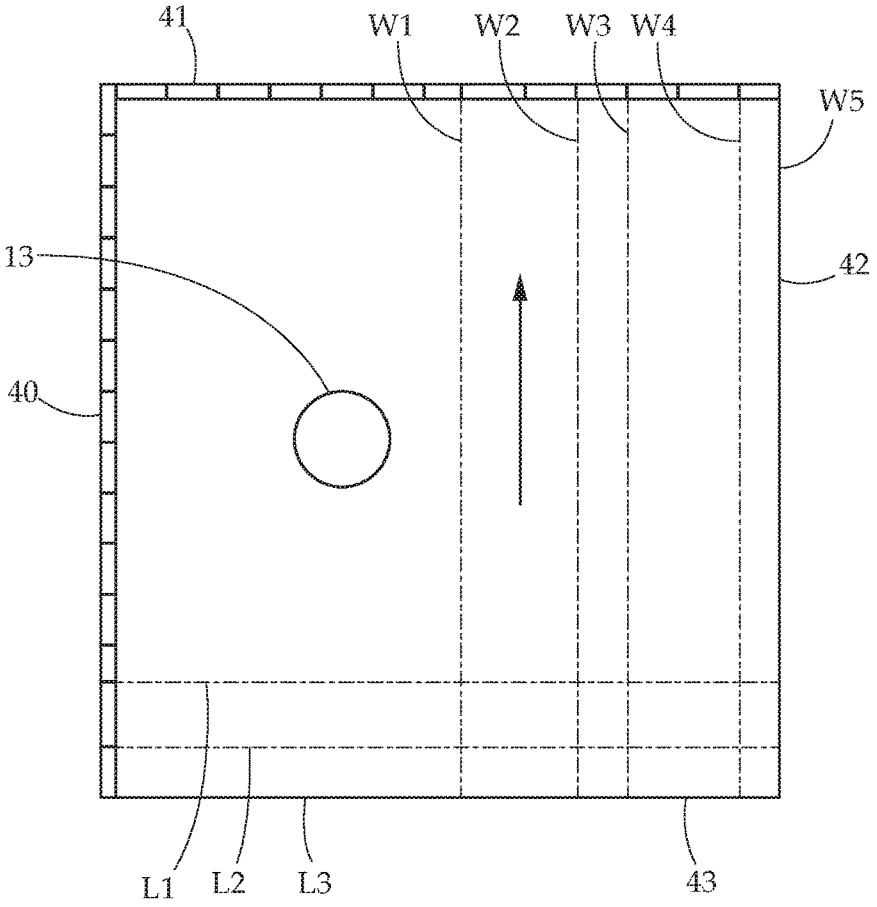
FIG. 4 provides an elevation view of yet another embodiment of the present invention.
Figure 5:
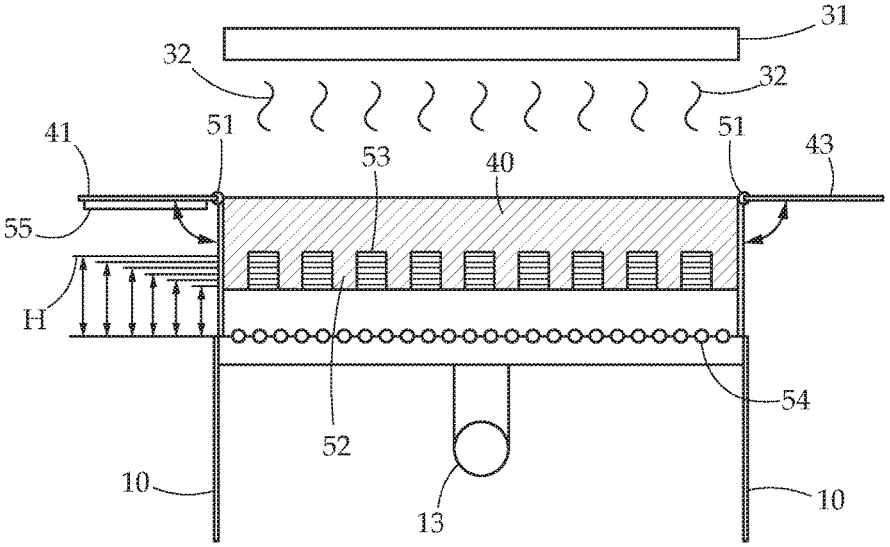
FIG. 5 provides a side view of still another embodiment of the present invention.
Figure 6:
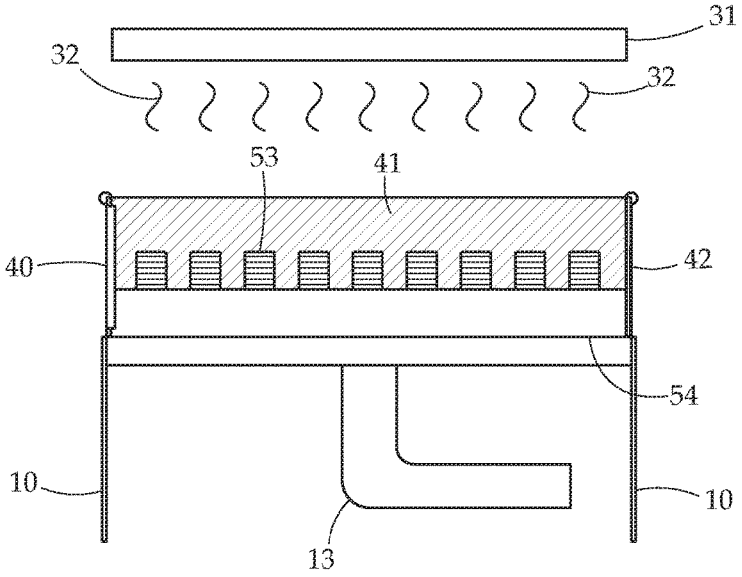
FIG. 6 provides a side view of yet still another embodiment of the present invention.

FIGS. 4-6 provide various views of embodiments of a drying system with an adjustable base to allow for drying of various sized foam assemblies. The device has a stationary side wall 40, an adjustable side wall 42, an adjustable end wall 43, and an end wall 41. In some embodiments, sidewall 40 and end wall 41 may have a padding or inflatable bag portion 55 to provide pressure against a foam assembly to control air entry at the foam-wall interface. A similar padding or inflatable bag portion 52 may be provided on side wall 40. As seen in FIG. 4, the adjustable end wall 43 and side wall 42 may be adjusted to a number of lengths L1, L2, and L3, and a number of widths W1, W2, W3, W4, and W5, for example. In a particular embodiment, the foam drying system may be integrated into a system. As such, a foam assembly may enter into the drying system area, be dried for a time period, and then conveyed out of the area using the conveyor rollers 54. In such an embodiment, the foam may travel in direction D, for example. In a particular embodiment, end walls 41 and 43 may be able to be swung open to allow the foam assembly into and out of the drying base area. In the embodiment shown, hinges 51 allow this motion. Vents 53 are positioned on side wall 40. These vents 53 allow air to enter the sides of the foam assembly.

Figure 8:
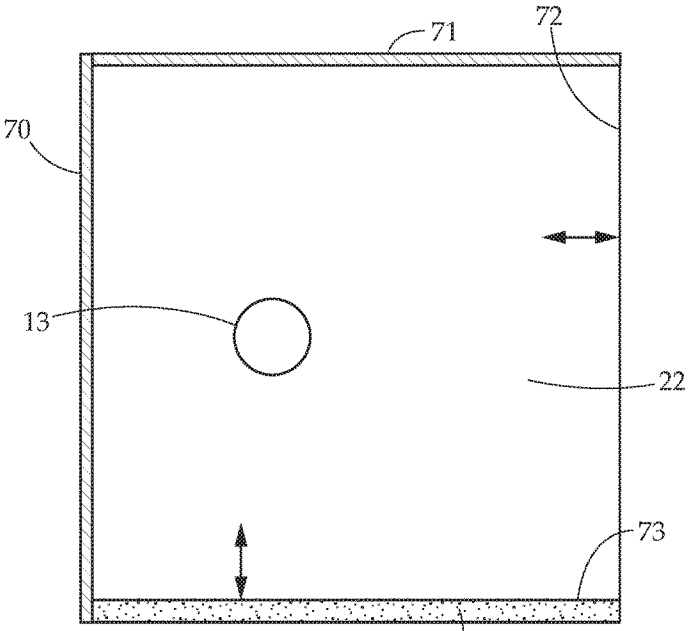
FIG. 8 provides an elevation view of another embodiment of the present invention.
Figure 7:
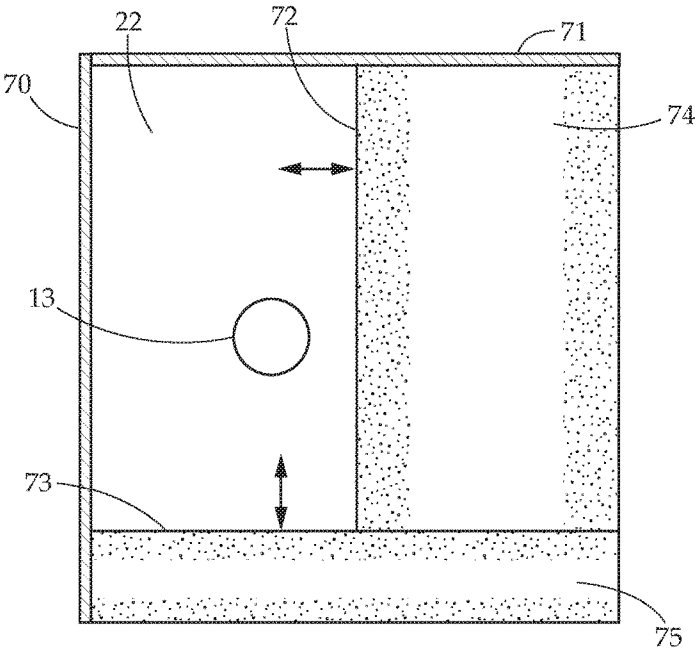
FIG. 7 provides an elevation view of another embodiment of the present invention.
Figure 9:
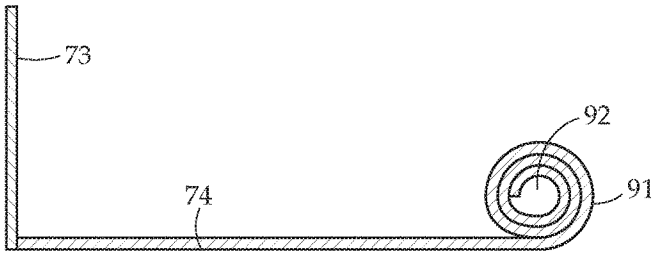
FIG. 9 provides a side view of an embodiment of an adjustable side wall of the present invention.

FIGS. 7 through 9 show various embodiments of another embodiment of the adjustable-area system. In this view, adjustment of the area of the drying device is achieved by adjustable walls 72 and 73, which are connected to air impermeable sheets 74 and 75 respectively. Typically air impermeable sheets 74, 75 are a rubberized or plastic material, but may also be a heavy fabric, or other membrane. The sheets can be connected to a rolling structure, for example as shown in FIG. 9, rolled area 91 and spool 92, to allow the sheet to be retracted by rolling and extended by unrolling. In varying embodiments, only an adjustable end wall or an adjustable side wall may be used, or both may be employed. The adjustable walls 72, 73, may be slideable or otherwise movable to the desired position, and fixable in this position during drying operation. This allows for rapid adjustment of the device for variously sized foam assemblies with minimal downtime. The sheets 74, 75 may be guided by tracks on their ends. Further, each sheet 74, 75 may have an upwardly extending side wall 73 which provides a face to abut a foam assembly edge. The side wall 73 may be supported in any manner, for example at its ends, at its base, on tracks, and the like. In some embodiments, a force-applying device such as a piston or spring may be utilized to urge the side wall against a foam assembly therein. This structure may function to provide a more air-tight seal between the side wall and edge of the foam assembly to prevent air from leaking between the two.

While several variations of the present invention have been illustrated by way of example in preferred or particular embodiments, it is apparent that further embodiments could be developed within the spirit and scope of the present invention, or the inventive concept thereof. However, it is to be expressly understood that such modifications and adaptations are within the spirit and scope of the present invention.

What is claimed is:

1. A foam assembly drying device comprising:

a body of the foam assembly drying device having a planar air permeable base, the air permeable base adapted to receive a foam assembly, the foam assembly being formed of at least one piece of foam and a quantity of adhesive;

a vacuum source adapted to draw a low pressure on one side of the air permeable base upon activation such that air passes through the air permeable base when the vacuum source is activated; and an air heater, the air heater positioned on an opposite side of the air permeable base from the one side of the air permeable base, the heater adapted to heat air before passing the air permeable base.

2. The foam assembly drying device of claim 1 wherein the body further comprises a funnel shaped attachment below the air permeable base, the vacuum source connected to an outlet of the funnel shaped attachment.

3. The foam assembly drying device of claim 1 wherein the foam assembly drying device is adapted to draw heated air through the foam assembly when received on the air permeable base.

4. The foam assembly drying device of claim 1 further comprising an end wall extending approximately perpendicularly from the base, a position of the end wall being horizontally adjustable.

5. The foam assembly drying device of claim 4 further comprising a side wall extending approximately perpendicularly from the base, a position of the side wall being horizontally adjustable.

6. The foam assembly drying device of claim 1 further comprising a plurality of walls extending approximately perpendicularly from the base, wherein at least one of the plurality of walls defines a vent aperture.

7. The foam assembly drying device of claim 1 further comprising a plurality of walls extending approximately perpendicularly from the base, wherein at least one of the plurality of walls is pivotable to be parallel to the air permeable base.

8. The foam assembly drying device of claim 1 further comprising an air dryer, the air dryer positioned on an opposite side of the air permeable base from the one side of the air permeable base, the dryer adapted to dry air before passing the air permeable base.

9. The foam assembly drying device of claim 1 further comprising an end wall positioned above the base and movable along the base, the end wall having an air-impermeable sheet connected to a first side, such that when the end wall is moved to a position over a portion of the base, an area of the base is covered by the air impermeable sheet, preventing air from passing over the area of the base.

10. The foam assembly drying device of claim 1 wherein the air impermeable sheet is connected to a spool adapted to roll at least a portion of the air impermeable sheet.

11. A foam assembly drying device comprising:

a body of the foam assembly drying device having an air permeable base;

a foam assembly removably positioned on a top surface of the base, the foam assembly being formed of two or more foam pieces laminated together using a quantity of adhesive; and a vacuum source adapted to draw a low pressure on one side of the air permeable base upon activation such that air passes through the foam assembly and air permeable base when the vacuum source is activated.

12. The foam assembly drying device of claim 11 further comprising an air heater, the air heater positioned on an opposite side of the foam assembly from the air permeable base, the heater adapted to heat air before passing the foam assembly, and wherein the foam assembly drying device is adapted to draw a heated air through the foam assembly.

13. The foam assembly drying device of claim 11 further comprising a plurality of walls extending approximately perpendicularly relative to the base.

14. The foam assembly drying device of claim 11 further comprising a wall extending approximately perpendicularly from the base, a position of the wall being adjustable based on a size of the foam assembly.

15. The foam assembly drying device of claim 11 further comprising a wall positioned above the base and movable relative to the base, the wall having an air-impermeable sheet connected to a first side, such that when the wall is positioned over a portion of the base, an area of the base is covered by the air impermeable sheet, preventing air from passing over the area of the base, the wall positioned over the base to abut or be adjacent to an edge of the foam assembly.

16. The foam assembly drying device of claim 15 wherein the air impermeable sheet is connected to a spool adapted to roll at least a portion of the air impermeable sheet.

17. A foam assembly drying device comprising:

a body of the foam assembly drying device having a planar air permeable base, the air permeable base adapted to receive a foam assembly, the foam assembly being formed of at least one piece of foam and a quantity of adhesive; and a vacuum source adapted to draw a low pressure on one side of the air permeable base upon activation such that air passes through the air permeable base when the vacuum source is activated; and a wall extending approximately perpendicularly relative to the base, a horizontal position of the wall being adjustable to abut or be adjacent to an end of the foam assembly when received on the base; and wherein the foam assembly drying device is adapted to draw air through the foam assembly when received on the base.

18. The foam assembly drying device of claim 17 further comprising an air heater, the air heater positioned on an opposite side of the base from the vacuum source, the heater adapted to heat air before passing the air permeable base, and wherein the foam assembly drying device is adapted to draw a heated air through the foam assembly.

19. The foam assembly drying device of claim 17 wherein the foam assembly is movable to the air permeable base via a conveyor.

20. The foam assembly drying device of claim 17 wherein the wall having an air-impermeable sheet connected to a first side, such that when the wall is moved to a position over a portion of the base, an area of the base is covered by the air impermeable sheet, preventing air from passing over the area of the base.

* * * * *